US006000872A

United States Patent [19]

Velicka et al.

[11] Patent Number: 6,000,872

[45] Date of Patent: Dec. 14, 1999

[54] AIR-TIGHT POMADE DISPENSER

[75] Inventors: Alvydas Velicka, Watertown, Conn.; John Pfrommer, St. Petersburg, Fla.

[73] Assignee: Eyelematic Manufacturing Co., Inc., Watertown, Conn.

[21] Appl. No.: 09/148,387

[22] Filed: Sep. 4, 1998

[51] Int. Cl.[6] ..... B34K 23/00

[52] U.S. Cl. ..... 401/98; 401/88

[58] Field of Search ..... 401/78, 98, 68, 401/124, 202, 49, 55, 88

[56] References Cited

U.S. PATENT DOCUMENTS

| | | | |
|---|---|---|---|
| 2,345,315 | 3/1944 | Anderson | 401/78 |
| 2,964,045 | 12/1960 | Otto et al. | 401/98 |
| 2,964,170 | 12/1960 | Otto et al. | 401/78 |
| 3,124,245 | 3/1964 | Hopgood . | |
| 3,252,446 | 5/1966 | Bateman | 401/98 |
| 3,380,795 | 4/1968 | Gruska . | |
| 3,493,309 | 2/1970 | Grisel . | |
| 4,750,882 | 6/1988 | Bouix . | |
| 5,181,790 | 1/1993 | Lucas | 401/98 |
| 5,468,084 | 11/1995 | Boninsegni et al. . | |
| 5,533,823 | 7/1996 | Pierpont et al. . | |
| 5,560,727 | 10/1996 | Vaupel . | |

FOREIGN PATENT DOCUMENTS

| | | |
|---|---|---|
| 2143212 | 2/1985 | United Kingdom . |

*Primary Examiner*—David J. Walczak
*Attorney, Agent, or Firm*—Ware, Fressola, Van Der Sluys & Adolphson LLP

[57] ABSTRACT

A pomade dispenser having an air-tight seal is disclosed. The pomade dispenser of the present invention includes a base having a resiliently deformable tapered sealing extension at an end of the base, a cap having an internal reverse taper, and cooperating features for holding the cap to the base. The deformable tapered sealing extension includes an extension sealing surface for contacting a cap sealing surface included on the internal reverse taper of the cap.

19 Claims, 5 Drawing Sheets

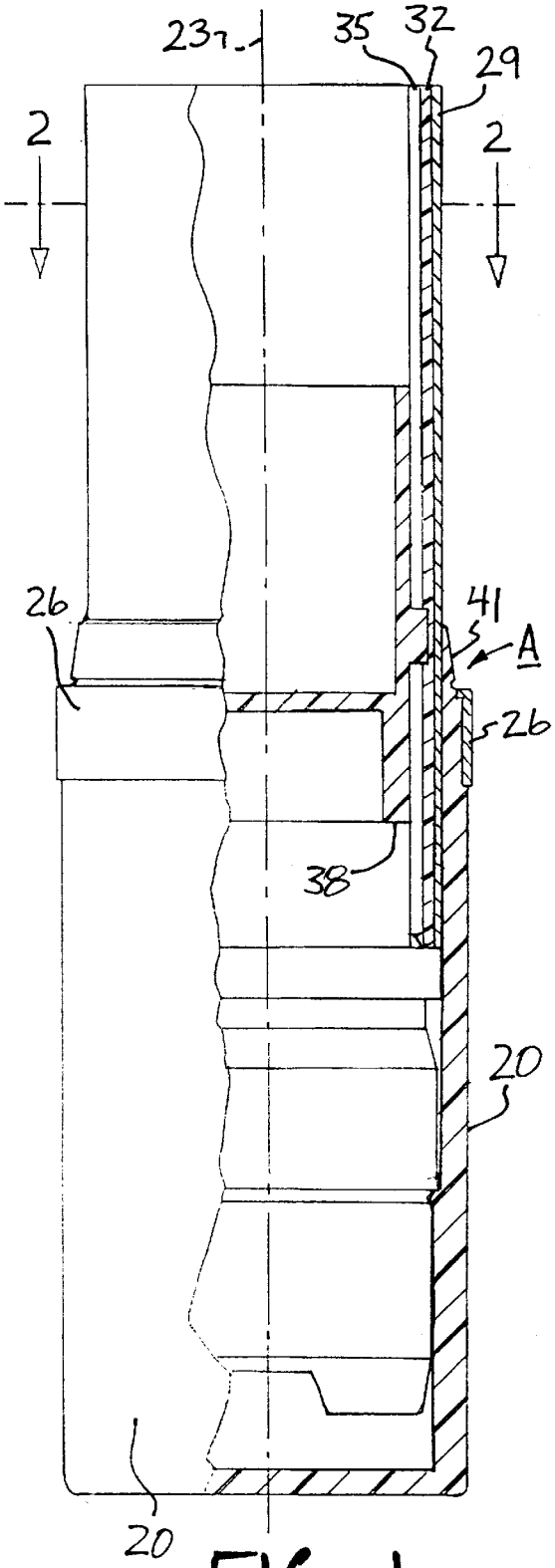
FIG. 1
FIG. 2
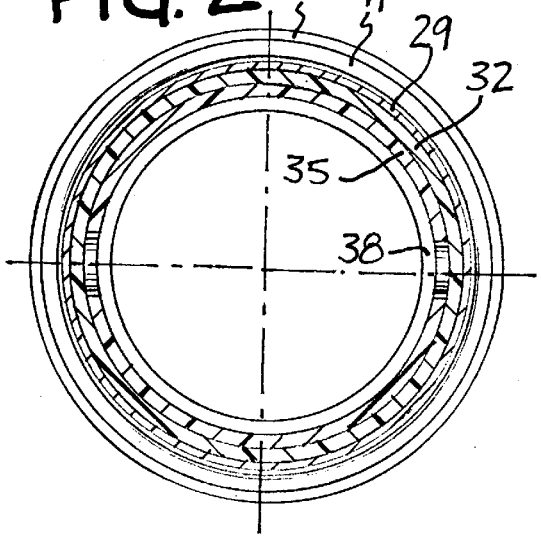
FIG. 3
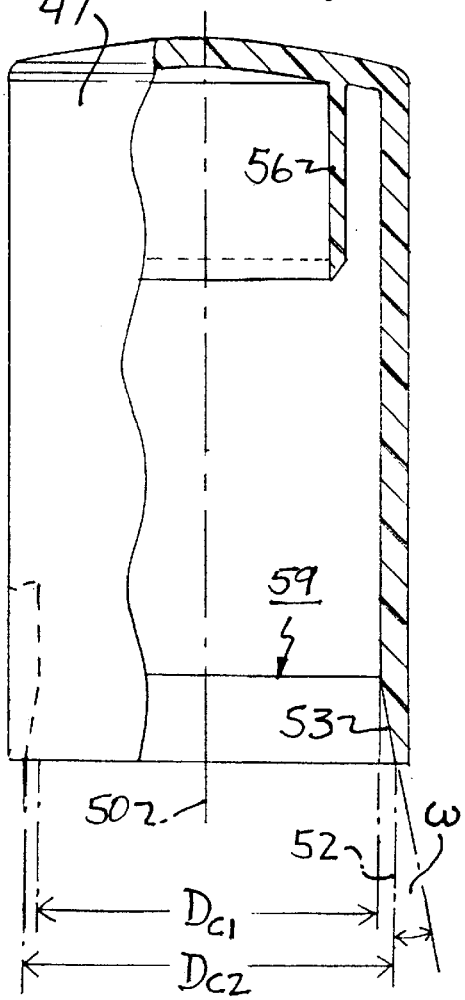

AIR-TIGHT POMADE DISPENSER

BACKGROUND OF THE INVENTION

1. Field of the Invention

The present invention relates generally to a dispenser for holding a pomade having volatile ingredients. More particularly, the present invention relates to forming a seal for preventing volatile ingredients in a pomade, such as lipstick, antiperspirant, insect repellent or adhesive paste from escaping from the dispenser.

2. Discussion of Related Art

In the prior art, a pomade dispenser is comprised of a pomade partially disposed within a movable elevator cup having a pair of lugs. The elevator cup is disposed within a vertically slotted inner body, which is in turn disposed within a helically slotted cam body, also called a "cam." Each lug of the elevator cup extends into both a vertical slot of the inner body and a helical slot of the cam. By rotating the inner body relative to the cam, the elevator cup is caused via the lugs to move vertically in order to selectively expose the pomade. For ease of use, the inner body is connected to a base, and the cam is connected to a shell, also called an "A-shell," which is partially disposed within the base. Therefore, to vertically move the pomade, the A-shell is rotated with respect to the base.

When the pomade is not being used, it is desirable to prevent volatile substances from leaving the pomade. Recently developed soft pomade formulations utilize volatile solvents to maintain the desired homogeneous distribution of active and inactive ingredients throughout the soft pomade. Such volatile solvents evaporate more readily than conventional pomade ingredients, producing undesirable shrinkage of the pomade. Such shrinkage causes the pomade to detach from the elevator cup, and drop out of the dispenser, destroying the utility of the pomade before the pomade has been used up to the desired extent.

In the prior art, to prevent the volatile ingredients from leaving the pomade, the pomade is lowered into the A-shell and a cap is placed over the A-shell. Normally, the cap extends over both that portion of the A-shell which extends from the base as well as part of the base. The vertical inside surface of the cap is sized to contact the vertical outside surface of the base. Alternatively, the base may have a decorative band attached to the outside surface of the base which provides the vertical sealing surface for contacting the vertical inside surface of the cap. However, the vertical inside surface of the cap and the vertical outside surface of the base or decorative band are not designed to provide an airtight seal.

In some prior art designs, an annular flange extending from the base or the decorative band is added to provide an interference fit between the inside vertical surface of the cap and the flange, thereby providing a seal which is at best only along a thin annular line where the flange contacts the cap. In such a design, any deformity in the flange or the cap will permit volatile ingredients from the pomade to pass between the cap and the flange. Furthermore, a small amount of debris on the cap or the flange located along the thin annular line where the flange would normally contact the cap will permit volatile ingredients to pass between the cap and the flange. Consequently, these designs do not seal against evaporative loss of volatile ingredients.

The base-cap dispenser sealing features of the present invention, as well as the internal dispenser-sealing features of the co-pending Seneco-Kezema application filed under Attorney Docket Number 3-351-13 have successfully achieved substantially airtight sealing of pomade dispensers. This sealing has minimized or virtually eliminated the undesired shrinkage of pomade, even during extended periods of storage in inventory, or of non-use by the ultimate consumer. The useful life of these products and their value have thus been substantially increased by these sealing features.

SUMMARY OF THE INVENTION

Accordingly, it is an object of the present invention to minimize or eliminate evaporative escape of volatile ingredients from the pomade.

The foregoing object is realized by the pomade dispenser of the present invention which includes a base having a resiliently deformable tapered sealing extension at an end of the base, a cap having an internal reverse taper, and a means for holding the cap to the base. The tapered sealing extension includes an extension sealing surface for contacting a cap sealing surface included on the internal reverse taper of the cap.

The extension sealing surface is disposed between a first extension diameter $D_{E1}$, and a second extension diameter $D_{E2}$, and when the extension sealing surface is not contacting another portion of the pomade dispenser, the extension sealing surface defines an acute extension angle $\theta$ with respect to a base center line. The cap sealing surface is disposed between a first cap diameter $D_{C1}$, and a second cap diameter $D_{C2}$ and defines an acute cap angle $\omega$ with respect to a cap center line when the cap sealing surface is not contacting another portion of the pomade dispenser. In order to provide a seal between the extension sealing surface and the cap sealing surface, angle $\theta$ is less than angle $\omega$ for any cross-section of the pomade dispenser parallel to and containing the respective center line.

Other objects and advantages of the present invention will become apparent to those skilled in the art from the following detailed description read in conjunction with the attached drawings and claims appended hereto. The invention comprises the features of construction, combinations of elements, and arrangements of parts which are exemplified in the constructions hereinafter set forth, and the scope of the invention is indicated in the claims.

BRIEF DESCRIPTION OF THE DRAWINGS

For a fuller understanding of the nature and objects of the invention, reference should be made to the following detailed description taken in connection with the accompanying drawings which are enlarged views of the pomade dispenser of the present invention, in which:

FIG. 1 is a partially cross-sectioned side view of a pomade dispenser without the cap according to the present invention;

FIG. 2 is a cross-sectioned top view of the dispenser shown in FIG. 1;

FIG. 3 is a partially cross-sectioned side view of the cap according to the present invention;

FIGS. 4–9 are greatly enlarged fragmentary views of a portion of the pomade dispenser according to the present invention in which:

FIG. 4 is a cross-sectioned side view of the pomade dispenser in the area generally indicated as "A" in FIG. 1;

FIG. 5 is a cross sectioned side view of three components of the pomade dispenser shown in FIG. 4;

FIG. 6 is cross-sectioned side view of three components of the pomade dispenser shown in FIG. 4 with the cap removed;

FIG. 7 is a cross-sectioned side view of an alternative embodiment of the present invention;

FIG. 8 is a cross sectioned side view of three components of the pomade dispenser shown in FIG. 7;

FIG. 9 is cross-sectioned side view of three components of the pomade dispenser shown in FIG. 7 with the cap removed.

DETAILED DESCRIPTION OF THE INVENTION

Figure 6:
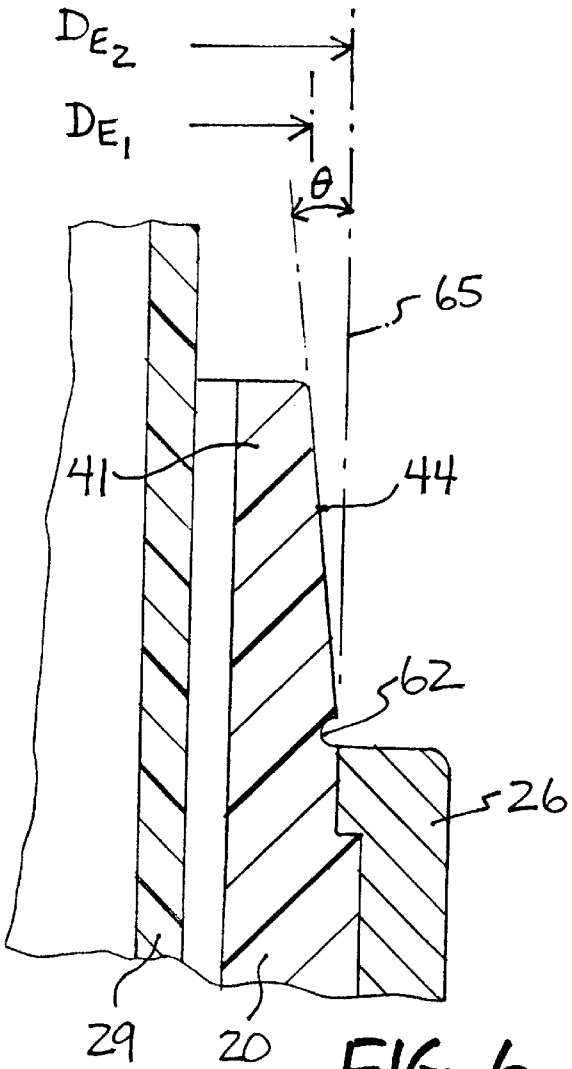

FIG. 1 shows a partially cross-sectioned side view of a pomade dispenser without the cap according to the present invention. In FIG. 1, a base 20 disposed about a longitudinal base center line 23 is shown having a decorative band 26 connected to the base 20. Within the base is an A-shell 29, a cam 32, an inner body 35 and an elevator cup 38. The elevator cup 38 is shown in FIG. 1 without the pomade. At an open upper end of the base 20 is a resiliently deformable sealing extension 41 having an extension sealing surface 44 (shown in FIGS. 5 and 6), having a taper angle θ and being disposed between a first extension diameter $D_{E1}$ and a second larger extension diameter $D_{E2}$ (FIG. 6). FIG. 2 shows the decorative band 26, sealing extension 41, A-shell 29, cam 32, inner body 35 and elevator cup 38 viewed as indicated by the line 2—2 in FIG. 1

FIG. 3 shows a cap 47 according to the present invention. The cap 47 is disposed about a longitudinal cap center line 50, and includes a tapered cap sealing surface 53 and an inner skirt 56. The cap sealing surface 53 is disposed between a first cap diameter $D_{C1}$ and a second larger cap diameter $D_{C2}$ (FIG. 3) and defines an internal reverse taper 59 having a taper angle ω from the longitudinal axis 23 (FIG. 1).

In FIG. 3, there is shown a reference line 52 which is parallel to the cap center line 50. The angle ω shown in FIG. 3 represents the acute angle between the reference line 52 and the cap sealing surface 53, and therefore the acute angle between the cap sealing surface 53 and the cap center line 50, when the cap sealing surface 53 is not contacting the extension sealing surface 44. The cap taper angle ω is preferably between about 2 degrees and about 12 degrees.

Figure 4:
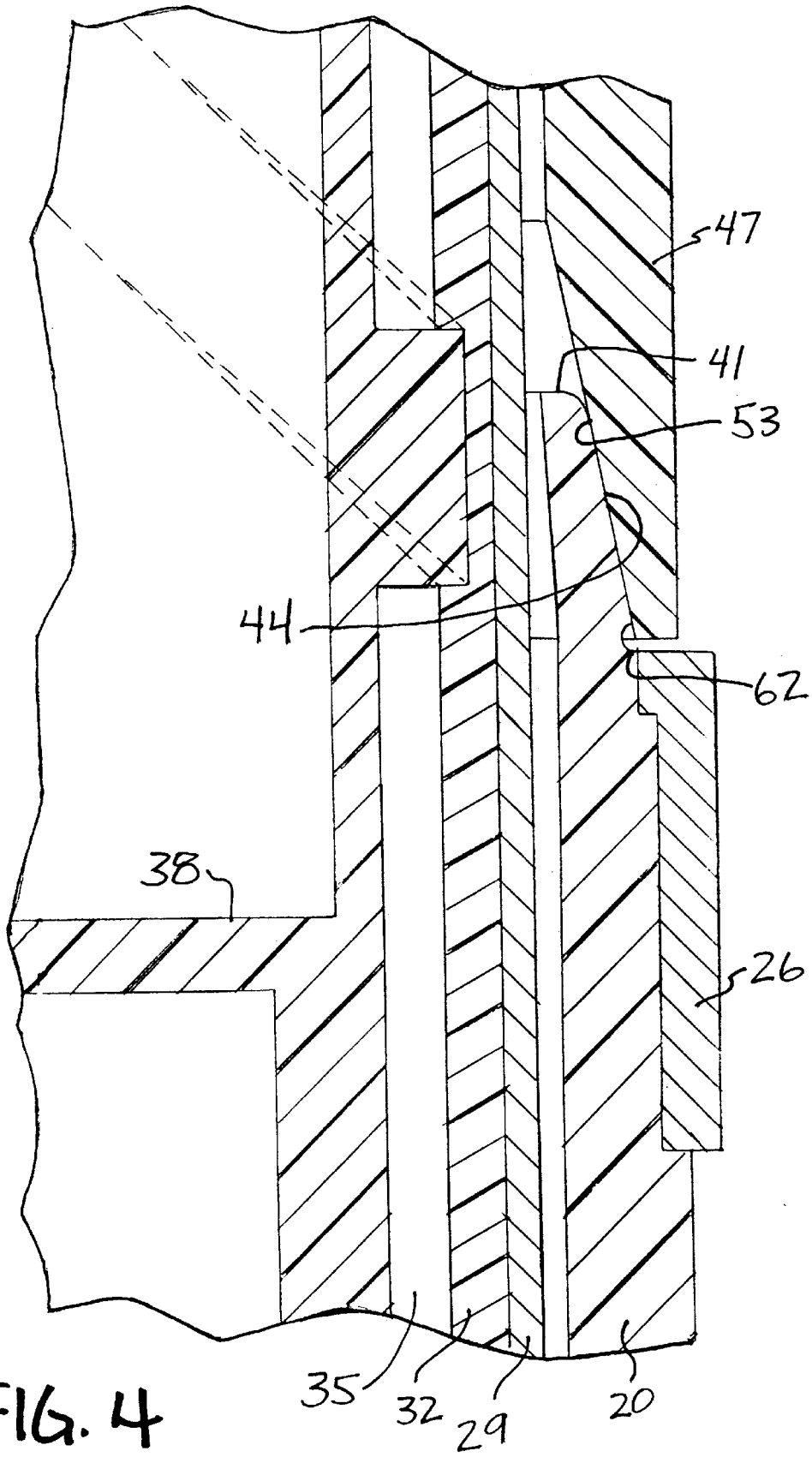

FIG. 4 a cross-sectioned side view of the pomade dispenser in the area generally indicated as "A" in FIG. 1. As shown in FIG. 4, the cap sealing surface 53 contacts the sealing extension 41. Also shown is a thickness reducing notch 62 at the base of the sealing extension 41, which permits the sealing extension 41 to be bendingly displaced toward the base center line 23 by the cap 47 so that the base extension sealing surface 44 and the cap sealing surface 53 contact each other over a substantial portion of the respective sealing surfaces 44, 53.

Figure 5:
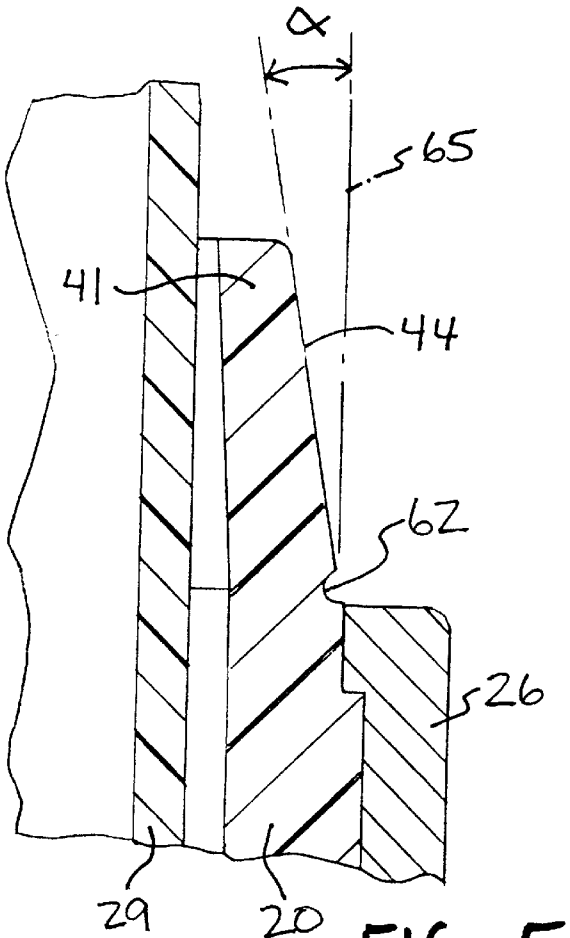

FIGS. 5 and 6 show how the sealing extension 41 moves in response to the cap 47. FIG. 5 shows the sealing extension 41 in the inwardly bent position when the cap sealing surface 53 is contacting the base extension sealing surface 44, while FIG. 6 shows the sealing extension 41 in the position when the cap sealing surface 53 is not contacting the extension sealing surface 44. In FIG. 5, there is shown a reference line 65 which is parallel to the base center line 23. The angle α shown in FIG. 5 represents the acute angle between the reference line 65 and the extension sealing surface 44, and therefore the acute angle between the extension sealing surface 44 and the base center line 23, when the cap sealing surface 53 is contacting the extension sealing surface 44. In FIG. 6, the acute extension angle θ represents the acute angle between the reference line 65 and the extension sealing surface 44, and therefore the acute angle between the extension sealing surface 44 and the base center line 23, when the cap sealing surface 53 is not contacting the extension sealing surface 44. In a preferred embodiment, the extension angle θ is preferably between 2.5 degrees and 4.5 degrees. It should be noted that the extension angle θ is less than the angle α because the cap 47 pushes the sealing extension 41 toward the A-shell 29 and the base center line 23.

Figure 7:
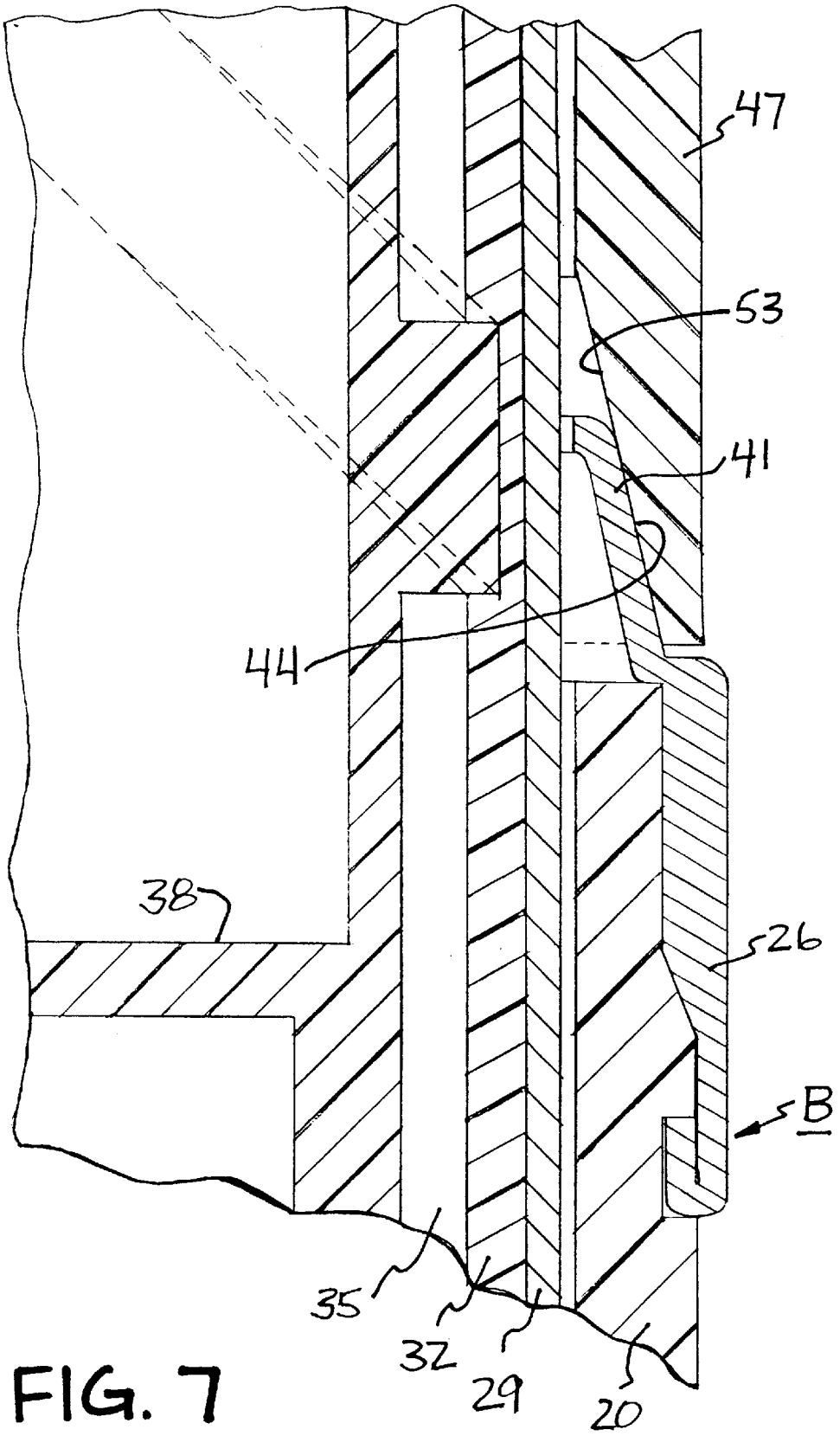

FIG. 7 is a cross-sectioned side view similar to that of FIG. 4, but in FIG. 7 there is shown an alternative embodiment of the present invention. In FIG. 7, the decorative band 26 extends beyond the base 20 to provide the extension sealing surface 44 (shown in FIGS. 8 and 9). The decorative band 26 may be connected to the base 20 with an interfering rib-and-groove snap fit at the area indicated by "B" in FIG. 7, creating a seal between the decorative band 26 and the base 20.

Figure 9:
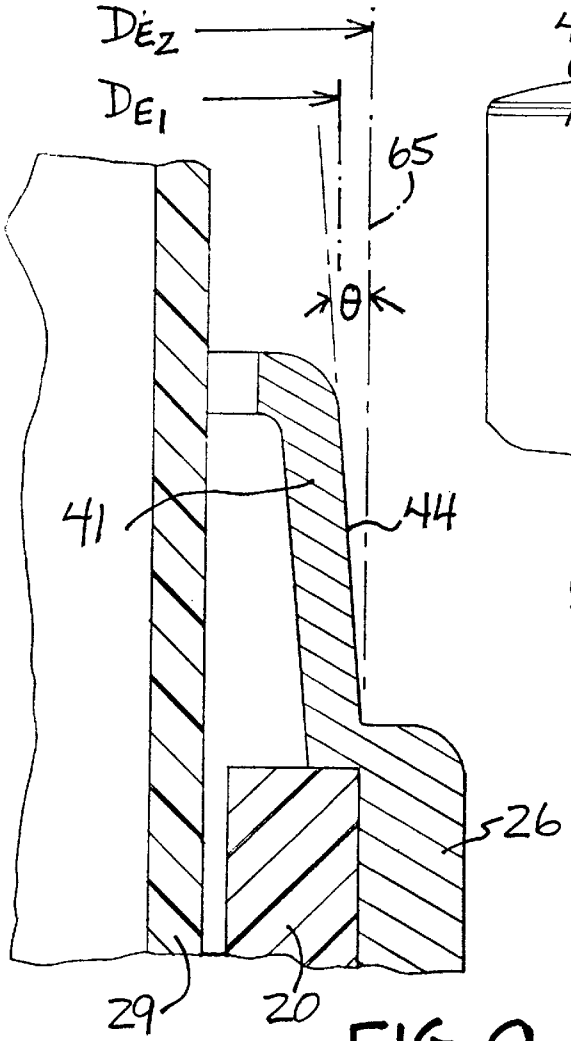
Figure 8:
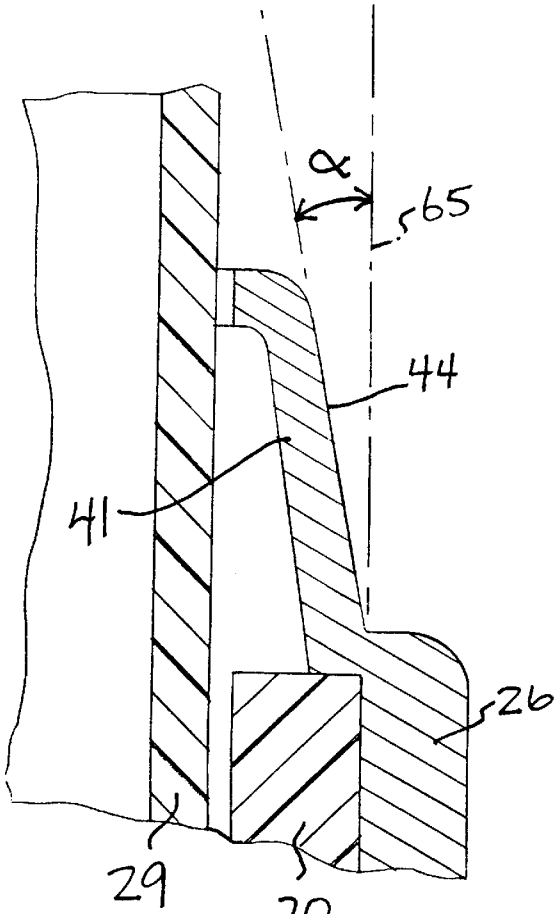

FIGS. 8 and 9 are similar to FIGS. 5 and 6 in that they show how the sealing extension 41 moves in response to the cap 47, but FIGS. 8 and 9 pertain to the alternative embodiment of the present invention described above. FIG. 8 shows the sealing extension 41 in the position when the cap sealing surface 53 is contacting the extension sealing surface 44, while FIG. 9 shows the sealing extension 41 in the position when the cap sealing surface 53 is not contacting the extension sealing surface 44. Like FIGS. 5 and 6, in FIGS. 8 and 9 there is shown a reference line 65 which is parallel to the base center line 23. In FIG. 8, the angle α represents the acute angle between the reference line 65 and the extension sealing surface 44, and therefore the acute angle between the extension sealing surface 44 and the base center line 23, when the cap sealing surface 53 is contacting the extension sealing surface 44. In FIG. 9, the extension angle θ represents the acute angle between the reference line 65 and the extension sealing surface 44, and therefore the acute angle between the extension sealing surface 44 and the base center line 23, when the cap sealing surface 53 is not contacting the extension sealing surface 44. The angle θ is preferably between 2.5 and 4.5 degrees. Like the embodiment shown in FIGS. 5 and 6, in the embodiment shown in FIGS. 8 and 9 the extension angle θ is less than the angle α because the cap 47 pushes the sealing extension 41 toward the A-shell 29 and the base center line 23.

In FIGS. 3–9 the extension sealing surface 44 is shown as a frustoconical surface disposed about the base center line 23 and having a cross-section perpendicular to the base center line which is circular. The cap sealing surface 53 is shown as an inverted frustoconical surface disposed about the cap center line 23 and having a cross-section perpendicular to the base center line which is circular. As such, when the cap 47 is positioned over the A-shell 29 and the base 20, the base center line 23 is substantially coextensive with the cap center line 50. However, the present invention is not limited to the geometries shown in the figures. The present invention may be made with sealing surfaces which have elliptical, triangular and square cross-sections, as well as other standard and nonstandard geometric shapes.

As shown in FIGS. 4 and 7, the sealing extension 41 is deformed toward the base center line 23 by the cap 47 until most of the extension sealing surface 44 contacts the cap sealing surface 53. In order to provide a seal between the extension sealing surface 44 and the cap sealing surface 53, the acute extension angle θ is less than the acute cap angle ω for any cross-section of the present invention parallel to and containing the respective center lines 23, 50.

It has been found that certain materials for the sealing extension 41 will provide the proper amount of resilient deformation required to provide the seal of the present invention. In the embodiment shown in FIG. 4, the sealing extension 41, which is an integral portion of the base 20, is preferably comprised of medium impact styrene (MIS), styrene acrylonitrile (SAN) or acrylonitrile butadiene styrene (ABS). In the alternative embodiment shown in FIG. 7, the sealing extension 41, which is an integral portion of the decorative band 26, is preferably comprised of aluminum. In both the embodiment shown in FIG. 4 and the alternative embodiment shown in FIG. 7, the cap is preferably comprised of MIS, SAN or ABS.

Figure 10:
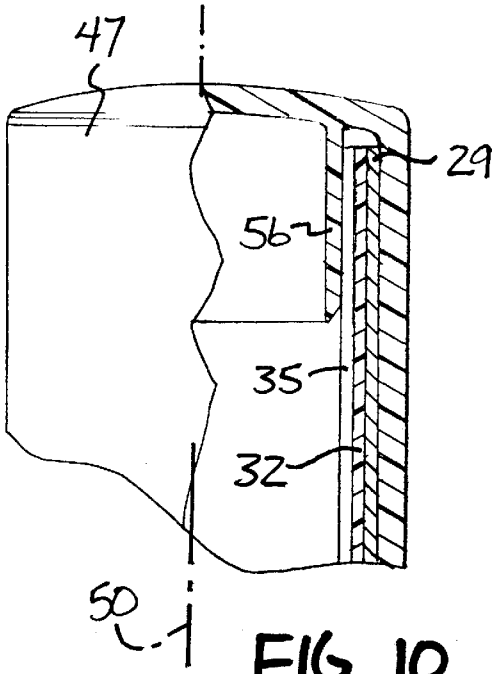
FIG. 10 is a partially cross-sectioned side view of the cap showing the A-shell contacting the cap.

It will be understood by those skilled in the art that a force must be applied to keep the sealing surfaces 44, 53 in contact with each other. Therefore, the present invention has a means for holding the cap 47 to the base 20, or more specifically, a means for holding the extension sealing surface 44 in contact with the cap sealing surface 53. In an embodiment of the present invention shown in FIG. 10, the cap 47 includes an inner skirt 56 depending from the cap top and spaced inward from the cap's outer wall, thus being positioned on the cap such that when the extension sealing surface 44 contacts the cap sealing surface 53, interference fits between the A-shell 29 and the cap 47 and between the inner skirt 56 and the inner body 35 are simultaneously created (FIG. 10), further sealing the pomade stick inside the dispenser cap-base assembly.

It will thus be seen that the objects set forth above, and those made apparent from the preceding description, are efficiently attained. Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. A pomade dispenser comprising:

a base disposed about a longitudinal base center line and having a resiliently deformable tapered sealing extension at an end of the base, wherein the tapered sealing extension has an extension sealing surface between a first extension diameter and a second extension diameter defining an acute extension angle θ with respect to the base center line when the extension sealing surface is not contacting another portion of the pomade dispenser;

a removable cap disposed about a longitudinal cap center line which is substantially coextensive with the base center line, and having an internal reverse taper which includes a cap sealing surface between a first cap diameter and a second cap diameter defining an acute cap angle ω with respect to the cap center line when the cap sealing surface is not contacting another portion of the pomade dispenser;

a means for holding the cap to the base; and wherein the extension sealing surface overlaps and contacts the cap sealing surface, and wherein θ is less than ω for any cross-section of the pomade dispenser parallel to and containing the respective center line.

2. The pomade dispenser of claim 1 wherein the angle ω is between about 2 degrees and about 12 degrees.

3. The pomade dispenser of claim 1, wherein the angle ω is about 5 degrees.

4. The pomade dispenser of claim 1 wherein the angle θ is between 2.5 degrees and 4.5 degrees.

5. The pomade dispenser of claim 1 wherein the extension sealing surface is frustoconical and the cap sealing surface is inverted frustoconical.

6. The pomade dispenser of claim 5 wherein the cap sealing surface is substantially symmetrically disposed about the cap center line and the extension sealing surface is substantially symmetrically disposed about the base center line.

7. The pomade dispenser of claim 1 wherein the means for holding is comprised of an A-shell at the base, the A-shell surrounding a helically slotted cam enclosing a longitudinally slotted inner body, and the A-shell is sized to provide an interference fit with the cap when the extension sealing surface is contacting the cap sealing surface.

8. The pomade dispenser of claim 7, wherein the cap includes an outer wall, and spaced inward therefrom a depending inner skirt positioned on the cap such that when the extension sealing surface is contacting the cap sealing surface, an interference fit between the inner body and the inner skirt is provided.

9. The pomade dispenser of claim 1, wherein the tapered sealing extension is an integral portion of the base.

10. The pomade dispenser of claim 9, wherein the tapered sealing extension includes a thickness reducing notch.

11. The pomade dispenser of claim 1, wherein the tapered sealing extension is an integral portion of a band connected to the base.

12. A pomade stick dispenser comprising:

a base disposed about a longitudinal base center line and having a resiliently deformable tapered sealing extension at an open end of the base, wherein the tapered sealing extension has an extension sealing surface between a first extension diameter and a second larger extension diameter defining an acute extension angle θ with respect to the base center line when the extension sealing surface is not contacting another portion of the pomade dispenser;

a removable cap dimensioned for removable telescoping assembly with said base and disposed about a longitudinal cap center line which is substantially coextensive with the base center line, and having an open end formed with an internal reverse taper which includes a cap sealing surface between a first cap diameter and a second larger cap diameter defining an acute cap angle ω with respect to the cap center line when the cap sealing surface is not contacting another portion of the pomade dispenser;

a means for holding the cap telescopingly assembled to the base; and wherein the extension sealing surface overlaps and contacts the cap sealing surface when said cap and said base are telescopingly assembled, and wherein θ is less than ω for any cross-section of the pomade dispenser parallel to and containing the respective center line, causing said deformable tapered base sealing extension to be resiliently bent inwardly, thereby enhancing the air-tight seal created by said overlapping contact of said two sealing surfaces.

13. The pomade dispenser of claim 12, wherein the sealing extension has a frustoconical sealing surface and the cap sealing surface has an inverted frustoconical sealing surface for contacting the frustoconical surface of the sealing extension.

14. The pomade dispenser of claim 12 wherein the means for holding is comprised of an A-shell connected to the base, the A-shell being sized to provide an interference fit with the cap when the sealing extension is contacting the cap sealing surface.

15. The pomade dispenser of claim 14, wherein said base has connected to it an A-shell surrounding a helically slotted cam enclosing a longitudinally slotted inner body, and wherein the cap includes an inner skirt positioned on the cap such that when the sealing extension is contacting the cap sealing surface, an interference fit between the inner body and the inner skirt is provided.

16. The pomade dispenser of claim 12, wherein the sealing extension is an integral portion of the base.

17. The pomade dispenser of claim 16, wherein the sealing extension includes a thickness reducing notch adjacent to the larger second extension diameter.

18. The pomade dispenser of claim 12, wherein the sealing extension is an integral portion of a band connected to the base.

19. The pomade dispenser of claim 18, wherein the band is connected to the base by an interfering rib-and-groove snap fit.

* * * * *